US008136377B2

(12) United States Patent
Yang

(10) Patent No.: US 8,136,377 B2
(45) Date of Patent: Mar. 20, 2012

(54) CARD LOCK STRUCTURE FOR SELECTIVELY LOCKING OR RELEASING A LOCK BARREL

(75) Inventor: Ping Jan Yang, Taipei (TW)

(73) Assignee: Cheng-Bao Engineering Enterprise Co. Ltd., New Taipei (TW)

( * ) Notice: Subject to any disclaimer, the term of this patent is extended or adjusted under 35 U.S.C. 154(b) by 457 days.

(21) Appl. No.: 12/318,633

(22) Filed: Jan. 5, 2009

(65) Prior Publication Data

US 2010/0170313 A1 Jul. 8, 2010

(51) Int. Cl.
*E05B 37/02* (2006.01)

(52) U.S. Cl. ..... 70/309; 70/210

(58) Field of Classification Search ..... 70/467, 70/475, 483–487, 150, 151 R, 210, 211, 213, 70/215–217, 405, 367–369, 309
See application file for complete search history.

(56) References Cited

U.S. PATENT DOCUMENTS

| | | | | | |
|---|---|---|---|---|---|
| 876,550 | A * | 1/1908 | Hopheinz | 70/303 R |
| 1,518,950 | A * | 12/1924 | Zweiman | 70/309 |
| 2,732,703 | A * | 1/1956 | Noregaard | 70/211 |
| 3,680,336 | A * | 8/1972 | Schendel | 70/276 |
| 3,995,460 | A * | 12/1976 | Sedley | 70/210 |
| 4,133,194 | A * | 1/1979 | Sedley et al. | 70/222 |
| 4,312,198 | A * | 1/1982 | Sedley | 70/276 |
| 4,676,083 | A * | 6/1987 | Sedley et al. | 70/276 |
| 5,267,460 | A * | 12/1993 | Burleigh | 70/309 |
| 5,291,766 | A * | 3/1994 | Eisermann | 70/276 |
| 5,575,164 | A * | 11/1996 | Ohsawa | 70/303 A |
| 5,653,134 | A * | 8/1997 | Lee et al. | 70/276 |
| 7,080,533 | B2 * | 7/2006 | Sedley | 70/276 |

* cited by examiner

*Primary Examiner* — Suzanne Barrett
(74) *Attorney, Agent, or Firm* — Chun-Ming Shih; HDLS IPR Services

(57) ABSTRACT

A card lock structure for selectively locking or releasing a lock barrel includes a card lock casing and a card barrel limiting mechanism. The card lock casing has a card-inserting groove. The card barrel limiting mechanism has a lock barrel limiting push rod pivotally disposed in the card lock casing, an elastic element disposed between the card lock casing and the lock barrel limiting push rod, and a movable pressing unit for pressing the lock barrel limiting push rod. One end of the lock barrel limiting push rod projects outside the card lock casing in order to selectively lock or release the lock barrel. When a card passes through the card-inserting groove to push the movable pressing unit to release the lock barrel limiting push rod, the lock barrel limited push is moved by the elasticity of the elastic element in order to release the lock barrel.

9 Claims, 5 Drawing Sheets

CARD LOCK STRUCTURE FOR SELECTIVELY LOCKING OR RELEASING A LOCK BARREL

BACKGROUND OF THE INVENTION

1. Field of the Invention

The present invention relates to a card lock structure, and particularly relates to a card lock structure for selectively locking or releasing a lock barrel.

2. Description of Related Art

Locks are widely used and consist of many types, such as key locks, cabinet locks and number locks, which are opened by keys or number combination, or card locks, which are opened by magnetic cards.

Cabinet locks can be used in some special locations, for instance, natatorium, gymnasium, and so on. Users can put belonging into a cabinet and lock the cabinet with a key to avoid losing something. However, keys of said cabinets can be inserted and withdrawn freely, which leads to keys becoming lost or discarded. This has costly consequences for the owners of the cabinets who may have to remake keys or even to change entire cabinets. Thus, it is very important to prevent keys from being removed from cabinets while the cabinets are not in use. The inventors of the present invention are of the opinion that the shortcomings above can be remedied and therefore suggest the present invention, which is a reasonable design and an effective improvement based on deep research.

SUMMARY OF THE INVENTION

One particular aspect of the present invention is to provide a card lock structure for selectively locking or releasing a lock barrel. The present invention selectively locks or releases the lock barrel so as to control the rotation of the lock barrel. When the lock barrel cannot be rotated, the key inserted into the lock barrel cannot be taken out. Hence, the lock such as key lock or number lock that uses the lock barrel cannot be used, for example, the key inserted into the lock barrel of the key lock cannot be rotated and taken out or the turn wheel of the number lock cannot be rotated.

In order to achieve the above-mentioned aspects, the present invention provides a card lock structure for selectively locking or releasing a lock barrel, including: a card lock casing and a card barrel limiting mechanism. The card lock casing has a card-inserting groove formed on a lateral side thereof. The card barrel limiting mechanism is disposed in the card lock casing. The card barrel limiting mechanism has a lock barrel limiting push rod pivotally disposed in the card lock casing, an elastic element disposed between an inner surface of the card lock casing and the lock barrel limiting push rod and a movable pressing unit for pressing the lock barrel limiting push rod. One end of the lock barrel limiting push rod projects outside the card lock casing in order to selectively lock or release the lock barrel. Therefore, when the movable pressing unit presses the lock barrel limiting push rod, the lock barrel is locked by the lock barrel limiting push rod; when a card passes through the card-inserting groove to push the movable pressing unit to release the lock barrel limiting push rod, the lock barrel limited push is moved by the elasticity of the elastic element in order to release the lock barrel.

The advantage of the present invention is the following: the card lock structure of the present invention can be built into the cabinet. When the card is not inserted into the lock barrel, the key cannot rotate the lock barrel, because the lock barrel is locked by the card lock structure. At the same time, the key is inserted into the lock barrel and cannot be taken out so as to prevent losing the key. When the lock barrel is released by the card lock structure, the key can be taken out. Thereby, by controlling the card, it can be avoided that a key of a cabinet is lost or willfully discarded.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objectives and advantages of the present invention will be more readily understood from the following detailed description when read in conjunction with the appended drawings, in which.

DETAILED DESCRIPTION OF PREFERRED EMBODIMENTS

Referring to FIGS. 1 to 5, the present invention provides a card lock structure for selectively locking or releasing a lock barrel L, including: a card lock casing 1 and a card barrel limiting mechanism 2.

Figure 3:
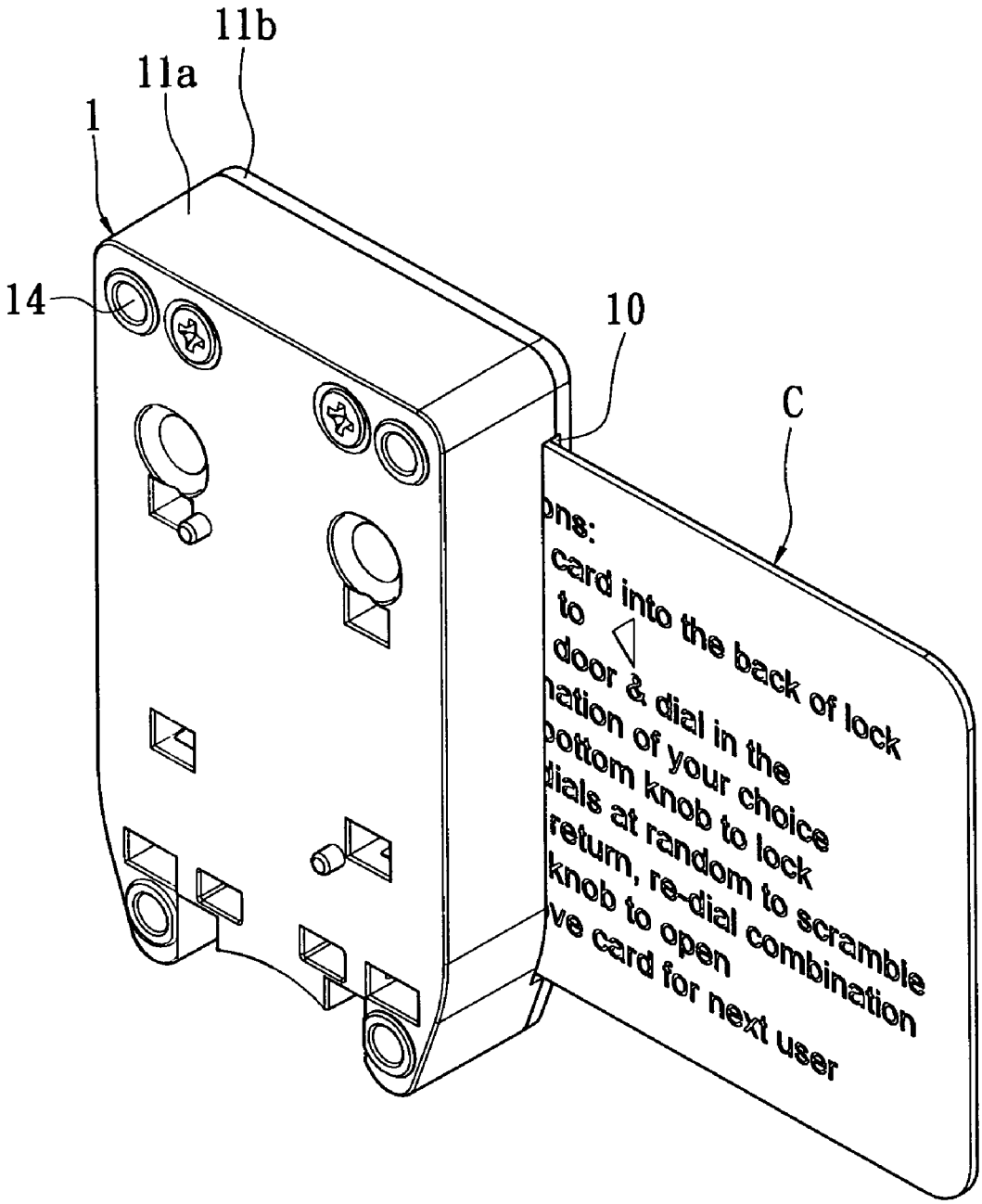
FIG. 3 is a perspective, assembled, schematic view of a card lock structure for selectively locking or releasing a lock barrel according to the present invention (after inserting a card into the card lock structure)

The card lock casing 1 has a card-inserting groove 10 formed on a lateral side thereof for receiving a card C (as shown in FIG. 3). In addition, the card lock casing 1 is composed of at least two shells (11*a*, 11*b*), and the at least two shells (11*a*, 11*b*) are assembled together by means of a plurality of screw bolts 12. Moreover, the card lock casing 1 further includes a support 13 disposed therein, and the support 13 has a pivot portion 130, an opening 131 formed under the pivot portion 130 and a retaining groove 132 formed beside one side of the opening 131. However, the feature of using the screw bolts 12 to assemble the at least two shells (11*a*, 11*b*) together is just an example. Any method for assembled the at least two shells (11*a*, 11*b*) together is protected by the present invention.

Furthermore, the card barrel limiting mechanism 2 is disposed in the card lock casing 1. The card barrel limiting mechanism 2 has a lock barrel limiting push rod 20, an elastic element 21 and a movable pressing unit 22. In addition, the lock barrel limiting push rod 20 is pivotally disposed in the card lock casing 1, the elastic element 21 is disposed between an inner surface of the card lock casing 1 and the lock barrel limiting push rod 20, and a movable pressing unit 22 presses the lock barrel limiting push rod so as to forcedly lock the lock barrel L by the lock barrel limiting push rod 20.

Moreover, the top side of the lock barrel limiting push rod 20 is pivotally disposed between the inner surface of the card lock casing 1 and the pivot portion 130. The lock barrel limiting push rod 20 has a receiving groove 201 formed on a middle portion thereof in order to receive the elastic element 21. One end 202 of the lock barrel limiting push rod 20 projects outside the card lock casing 1 in order to selectively lock or release the lock barrel L, and the lock barrel limiting push rod 20 is received in the opening 131.

Furthermore, the movable pressing unit 22 has a pin body 220, a movable body 221 and a torsion spring 222. The pin body 220 is disposed in the retaining portion 132, the movable body 221 is disposed around the pin body 220, and the torsion spring 222 is disposed around the pin body 220. In addition, one end 2220 of the torsion spring 222 is retained in the movable body 221, and another end 2221 of the torsion spring 222 abuts against the support 13. Hence, the end 2220 of the torsion spring 222 is fixed by the movable body 221, and the another end 2221 of the torsion spring 222 is fixed by the interference of the support 13. Therefore, the torsion force generated by the torsion spring 222 is forced on the movable body 221 to press the lock barrel limiting push rod 20.

Figure 1:
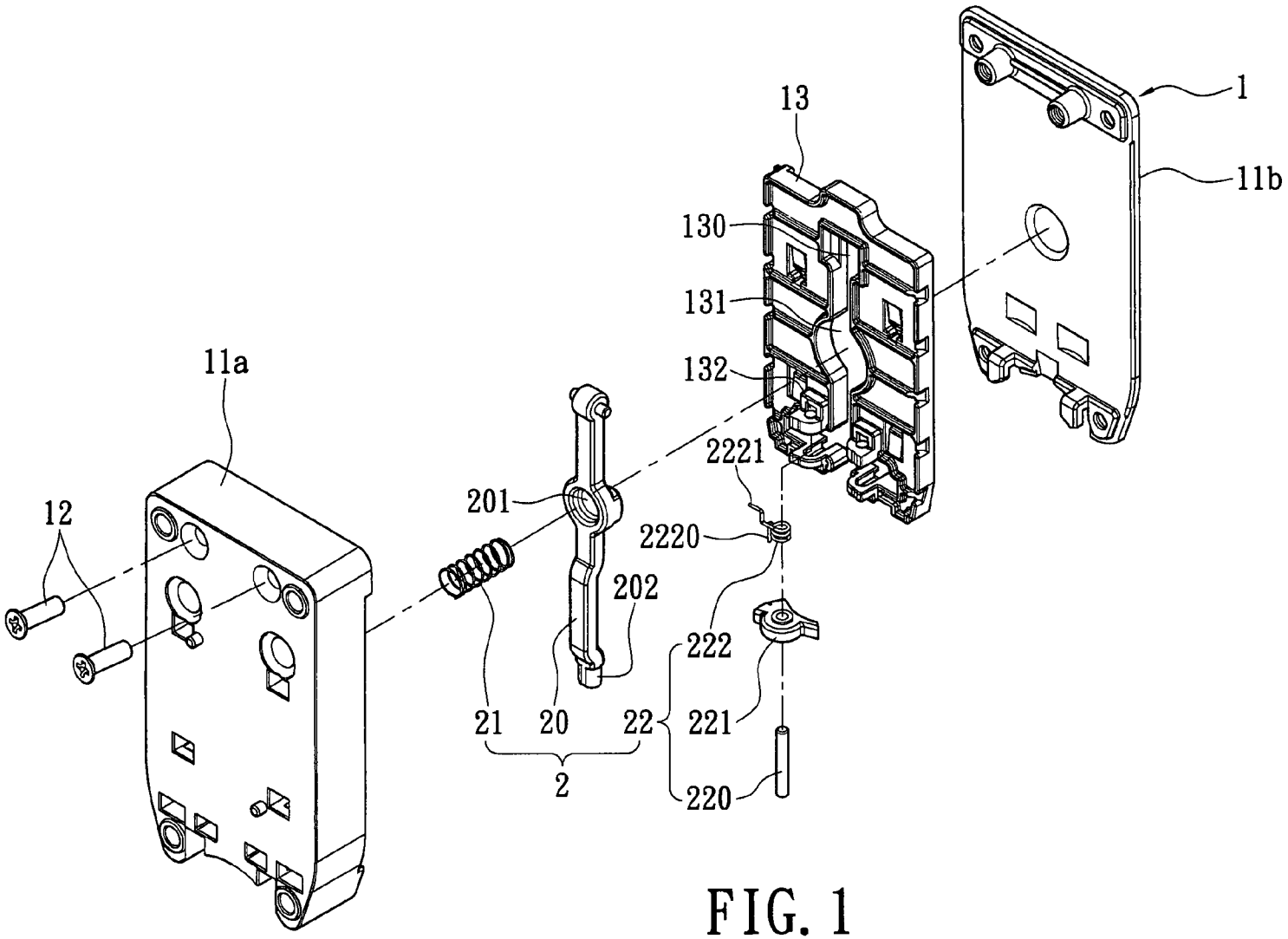
FIG. 1 is a perspective, exploded, schematic view of a card lock structure for selectively locking or releasing a lock barrel according to the present invention.
Figure 2:
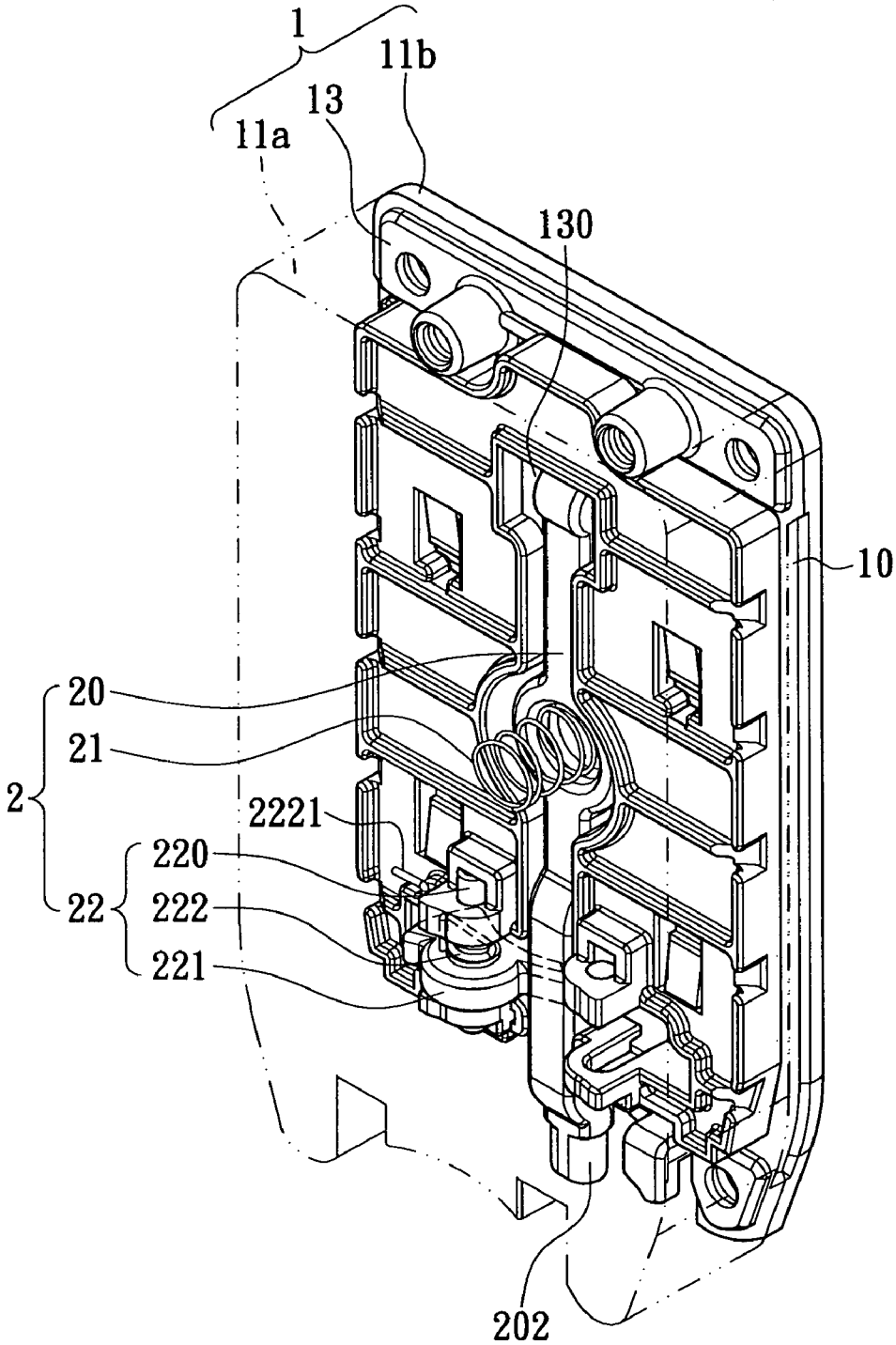
FIG. 2 is a perspective, assembled, schematic view of a card lock structure for selectively locking or releasing a lock barrel according to the present invention (before inserting a card into the card lock structure)
Figure 4:
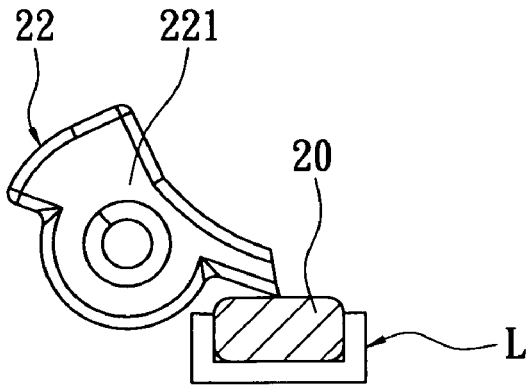
FIG. 4 is a schematic view of before pushing a movable pressing unit of the present invention (when the lock barrel is locked)
Figure 5:
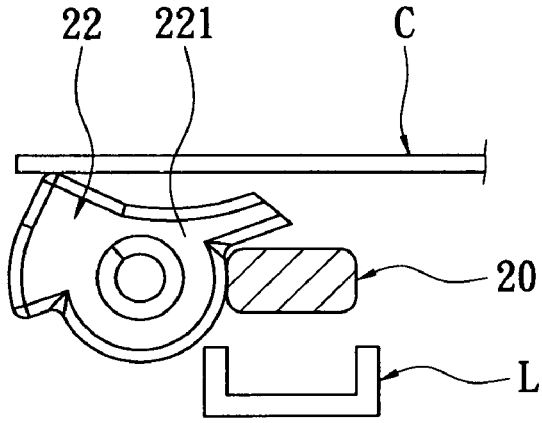
FIG. 5 is a schematic view of after pushing a movable pressing unit of the present invention (when the lock barrel is released)

Referring to FIGS. 2 and 4, when the movable body 221 of the movable pressing unit 22 presses the lock barrel limiting push rod 20, the lock barrel L is locked by the lock barrel limiting push rod 20. Referring to FIGS. 3 to 5, when the card C passes through the card-inserting groove 10 to push the movable body 221 of the movable pressing unit 22 to release the lock barrel limiting push rod 20, the lock barrel limited push 20 is moved by the elasticity of the elastic element 21 so as to release the lock barrel L.

In other words, referring to FIGS. 2 and 4, when the movable body 221 of the movable pressing unit 22 presses the lock barrel limiting push rod 20, the lock barrel L is locked by the end 202 of the lock barrel limiting push rod 20. Because the lock barrel L is locked by the card lock structure, the key cannot rotate the lock barrel L. At the same time, the key is inserted into the lock barrel L and cannot be taken out so as to prevent losing the key. Referring to FIGS. 3 to 5, when the card C passes through the card-inserting groove 10 to push the movable body 221 of the movable pressing unit 22 to release the lock barrel limiting push rod 20, the end 202 of the lock barrel limited push 20 is moved and far away from the lock barrel L by the elasticity of the elastic element 21 so as to release the lock barrel L. Because the lock barrel is released from the card lock structure, the key can be taken out. Thereby, by controlling the card, it can be avoided that a key of a cabinet is lost or willfully discarded.

Figure 6:
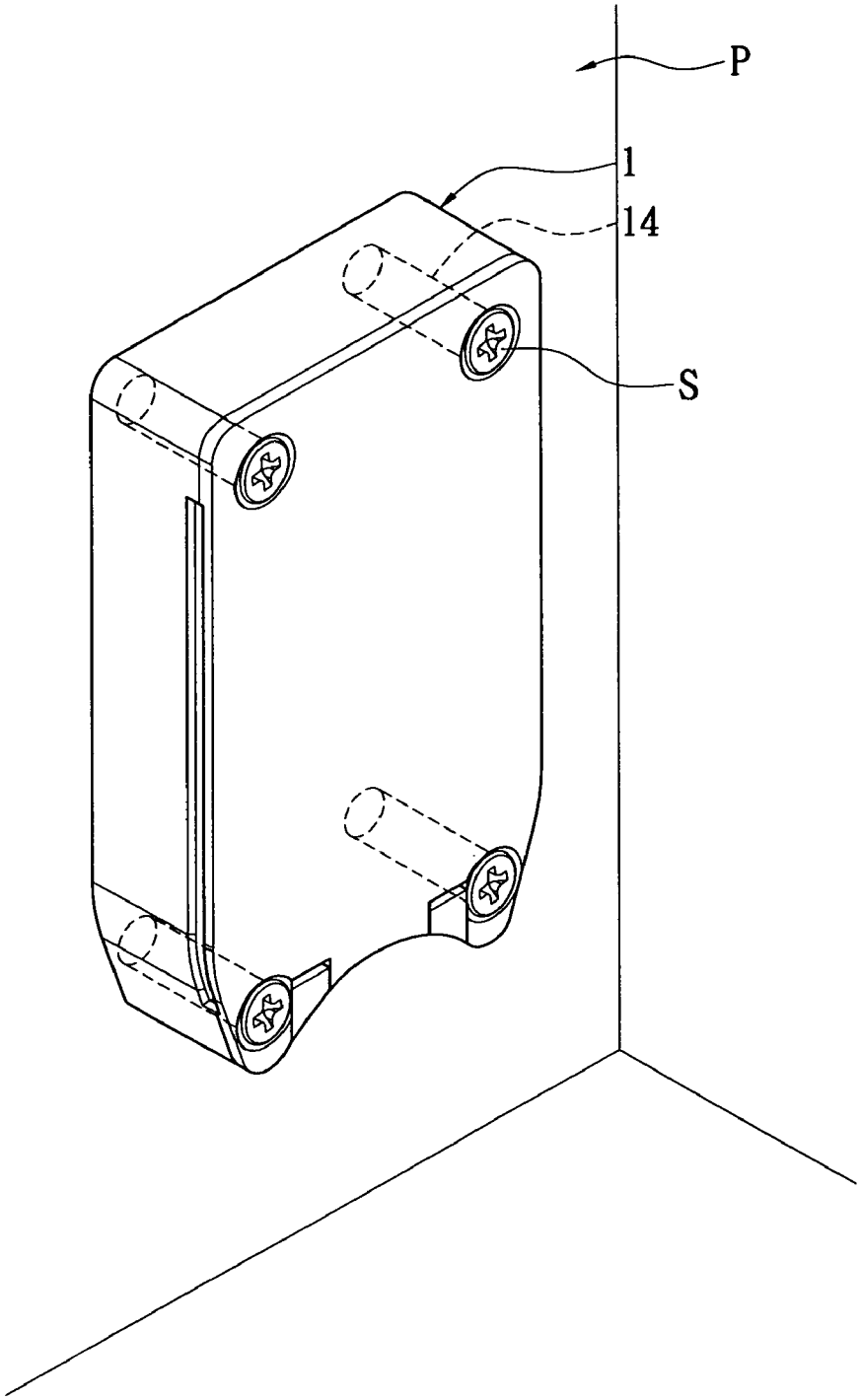
FIG. 6 is a perspective, schematic view of a card lock structure of the present invention being engaged with another object.

Referring to FIG. 6, the card lock casing 1 has a plurality of through holes 14. The card lock structure further includes a plurality of screw bolts S passing through the through holes 14 and being engaged with another object P in order to fix the card lock casing 1 on the object P. For example, the object P can be a cabinet. Hence, the card lock structure of the present invention can be disposed on the inner surface of the cabinet. When the card C has not be inserted into the card-inserting groove 10 yet, the lock barrel of the key lock or the number lock on the cabinet is locked by the end 202 of the lock barrel limiting push rod 20, so that the user cannot use the key lock (the key will be locked in the lock barrel of the key lock and the key cannot be taken out from the key lock) or the number lock.

In conclusion, the card lock structure of the present invention can be built into a cabinet. When the card has not been inserted into the lock barrel, the key cannot rotate the lock barrel, because the lock barrel is locked by the card lock structure, and the key can also not be taken out. When the lock barrel is released by the card lock structure, the key can be taken out. Thus, by controlling the card, it can be avoided that a key of a cabinet is lost or discarded.

Although the present invention has been described with reference to the preferred best molds thereof, it will be understood that the present invention is not limited to the details thereof. Various substitutions and modifications have been suggested in the foregoing description, and others will occur to those of ordinary skill in the art. Therefore, all such substitutions and modifications are intended to be embraced within the scope of the present invention as defined in the appended claims.

What is claimed is:

1. A card lock structure for selectively locking or releasing a lock barrel, comprising:

a card lock casing having a card-inserting groove formed on a lateral side thereof; and a card barrel limiting mechanism disposed in the card lock casing, wherein the card barrel limiting mechanism has a lock barrel limiting push rod pivotally disposed in the card lock casing, an elastic element disposed between an inner surface of the card lock casing and the lock barrel limiting push rod and a movable pressing unit for pressing the lock barrel limiting push rod, and one end of the lock barrel limiting push rod projects outside the card lock casing in order to selectively lock or release the lock barrel;

whereby, when the movable pressing unit presses the lock barrel limiting push rod, the lock barrel is locked by the lock barrel limiting push rod; when a card passes through the card-inserting groove to push the movable pressing unit to release the lock barrel limiting push rod, the lock barrel limiting push rod is moved by the elasticity of the elastic element in order to release the lock barrel;

wherein the card lock casing has a support disposed therein, and the support has a pivot portion, an opening formed under the pivot portion and a retaining groove formed beside one side of the opening; and wherein the movable pressing unit has a pin body disposed in the retaining portion, a movable body disposed around the pin body and a torsion spring disposed around the pin body.

2. The card lock structure as claimed in claim 1, wherein the card lock casing is composed of at least two shells.

3. The card lock structure as claimed in claim 2, wherein the at least two shells are assembled together by means of a plurality of screw bolts.

4. The card lock structure as claimed in claim 1, wherein the card lock casing has a plurality of through holes.

5. The card lock structure as claimed in claim 4, further comprising a plurality of screw bolts passing through the through holes and engaging with another object in order to fix the card lock casing on the object.

6. The card lock structure as claimed in claim 1, wherein a top side of the lock barrel limiting push rod is pivotally disposed between an inner surface of the card lock casing and the pivot portion.

7. The card lock structure as claimed in claim 1, wherein the lock barrel limiting push rod is received in the opening.

8. The card lock structure as claimed in claim 1, wherein one end of the torsion spring is retained in the movable body, and another end of the torsion spring abuts against the support.

9. The card lock structure as claimed in claim 1, wherein the lock barrel limiting push rod has a receiving groove formed on a middle portion thereof in order to receive the elastic element.

* * * * *